United States Patent [19]

Chiu

[11] Patent Number: 4,692,593

[45] Date of Patent: Sep. 8, 1987

[54] DOMESTIC ELECTRIC KILN

[76] Inventor: Chui-Wen Chiu, 7f, No. 27, Lane 330 Tun Hwa S. Rd., Taipei, Taiwan

[21] Appl. No.: 694,780

[22] Filed: Jan. 25, 1985

[51] Int. Cl.[4] ..... F27D 7/02

[52] U.S. Cl. ..... 219/362; 219/399; 219/401; 220/327; 432/120

[58] Field of Search ..... 219/362, 399, 401, 378; 220/327 X; 432/120

[56] References Cited

U.S. PATENT DOCUMENTS

| | | | |
|---|---|---|---|
| 3,095,186 | 7/1963 | Sondy | 432/120 X |
| 3,349,947 | 10/1967 | Zumwalt | 220/327 X |
| 3,825,723 | 7/1974 | Roeser | 219/362 |
| 3,897,609 | 8/1975 | Schmidt, Jr. | 220/327 X |
| 4,460,822 | 7/1944 | Alden et al. | 219/401 X |

*Primary Examiner*—Kenneth J. Ramsey

[57] ABSTRACT

A domestic electric kiln which also can be used as an ordinary electric radiator, comprised of: a heat resistant frame body with electric coils equipped around in its inner wall; a cover with an opening in its center; a safety lock on the other side of the cover; a water pipe for generating steam; a supporting plate which also facilitates the spreading of the steam throughout the inner chamber; a shell with double walls which serves an an air-cooling mechanism and a temperature regulator. The device is characterized by continuous flow of both steam and hot air in the kiln chamber, thus, enabling one to make high quality products of chinaware or pottery by oneself at home.

2 Claims, 6 Drawing Figures

DOMESTIC ELECTRIC KILN

BACKGROUND OF THE INVENTION

This invention relates to a domestic electric kiln which enables one to make chinaware and pottery at home by oneself, at the same time it also can be used as an ordinary electric radiator.

It is well known that, chinaware and pottery have become widely of interest for people in recent years. There are many people who are not only interested in collecting these kinds of things, but also in "trying" to make some of them by themselves. But the "trying" will never work unless the problem of equipment is solved.

The conventional electric furnace is so large in volume, and the distance between the embryo and the electric coils must be properly large, or cracks and deformations may be easily caused in the embryo. Therefore, the effective space of the furnace for potting is small and a large high quality chinaware or pottery is difficult to make.

SUMMARY OF THE INVENTION

It is, therefore, an object of this invention to provide a device which not only enables one to make chinaware and pottery at home by oneself but also can be used as an ordinary electric radiator. It is a further object of this invention to provide such device which possesses a continuous flow of steam and air in the chamber of the kiln as it is in use. Owing to the suitable condition of both temperature and humidity, relatively large and high quality chinaware and pottery can be made, and it would only require electrical power for 1000W-2000W which is usually provided by an ordinary electric radiator. It is a further object of this invention to provide a device which provides a relatively large effective space for potting the embryo of chinaware or pottery with small kiln because of the distance between the embryo and the heat source (electrical coils) could approach 1.5 MM.

The foregoing advantages and features of the present invention will become apparent from the following detailed description with the accompanying drawings.

BRIEF DESCRIPTION OF THE DRAWING FIGURES

DETAILED DESCRIPTION OF THE EMBODIMENTS

Figure 1:
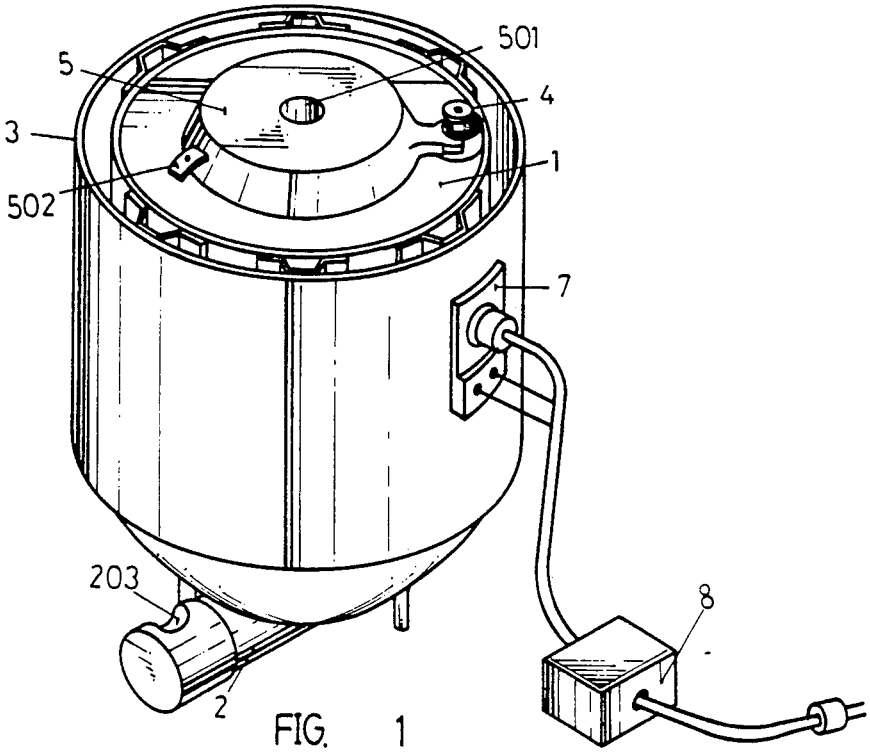
FIG. 1 is an out-side view of the present invention.
Figure 2A:
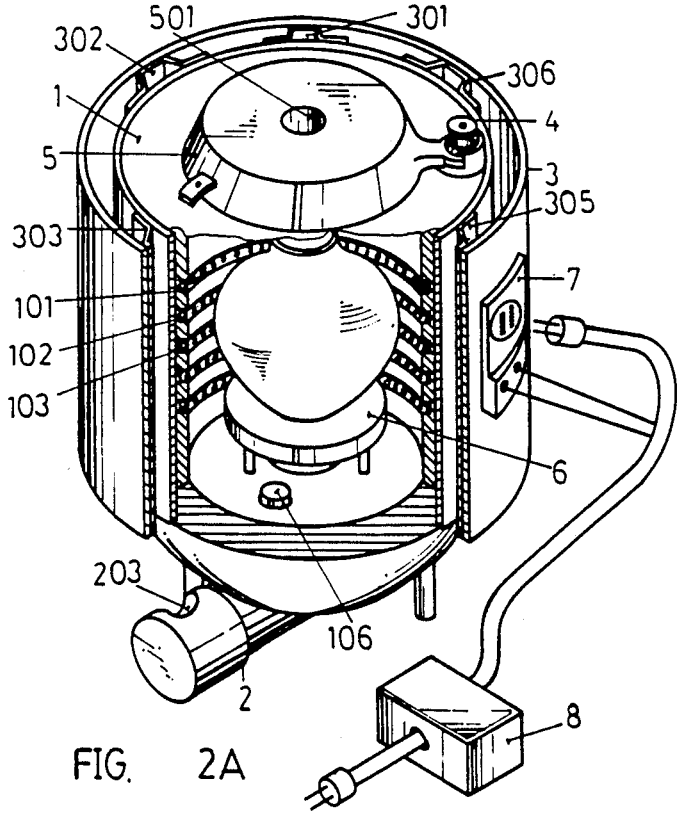
FIG. 2A is a cut-a-way view of the present invention.
Figure 2B:
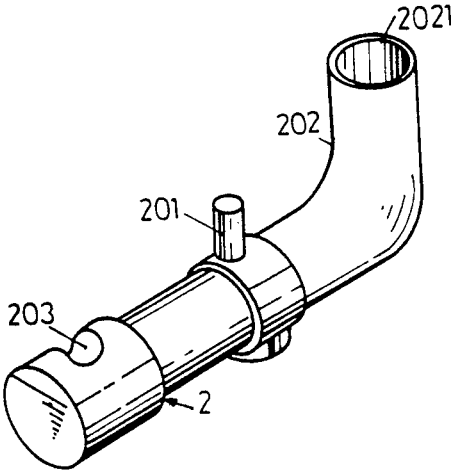
FIG. 2B is an out-side view of the water pipe.
Figure 2D:
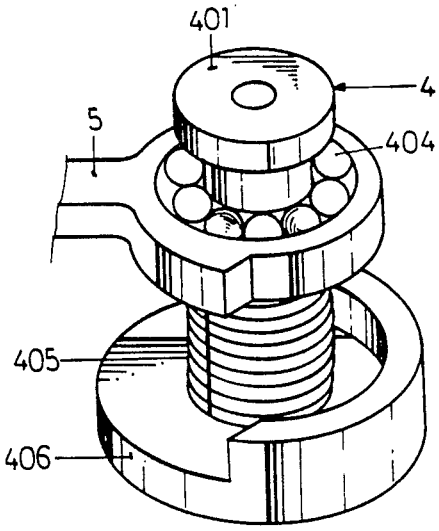
FIG. 2D is a out-side view of the safety lock mechanism on the kiln cover.

Reffering to the drawings, the frame body 1 of the kiln is made of a heat resistant substance and is equipped with electrical coils 101, 102, 103------ around its inner wall. There are two openings 106, 107 formed on the bottom of the kiln. Pipe 2 is a water container which has three openings 201, 202, 203 (FIG. 2B). One is the water inlet 203, another 201 is a heat conducting block, the other 202 is formed like an elbow part of the pipe 2 and serves as a steam outlet. Pipe 2 is set to the outside of the bottom by inserting the heat conducting block 201 and the steam outlet 202 through the two holes 106, 107 of the inner bottom of the kiln. A supporting rack 6 is placed in the kiln chamber to support the embryo of chinaware or pottery. When steam comes up, from the hole 107 at the bottom, it spreads throughout the kiln chamber because of the blocking to the rack 6, thus providing a continuous flow of steam and hot air in the chamber. The cover 5 has an opening 501 in the center which serves as an outlet for steam and hot air from the kiln chamber. The temperature inside the kiln chamber would be up to 1280° C. For the sake of safety and to prevent users from opening the cover accidentally, a safety lock 4 is set on the side of cover 5. The safety lock 4 is comprised of a bolt 405 with a round head 401 which serves as a handle (FIG. 2D). The bolt 405, which is engaged with a ball bearing 404 connected to the cover 5, can be screwed into a nut 406 formed on the top of the frame body 1 of the kiln. When the safety lock 4 is loosened, i.e., by turning the round handle 401, cover 5 is lifted and moved to the other side. The kiln is thus opened and one can put in or take out the embryo of chinaware or pottery. In addition to the safety lock 4, there is a latch 502 set on the opposite side of the cover 5 for more assurance. When the kiln is in use, the heat conducting block 201 would receive the heat generated by the electrical coils, thus vaporizing the water contained in the pipe 2. The hot steam generated from the steam outlet 2021 of the pipe 2 goes into the chamber. After spreading throughout the whole chamber, it finally leaves through the opening 501 of the cover 5. Thus, a continuous flow of steam and hot air would be maintained in the chamber of the kiln.

Figure 2C:
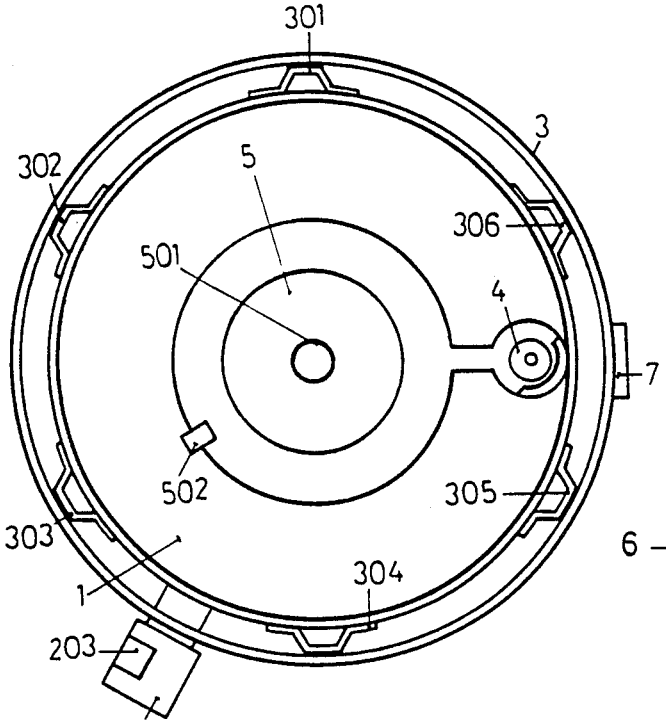
FIG. 2C is a plan view of the kiln shell.
Figure 2E:
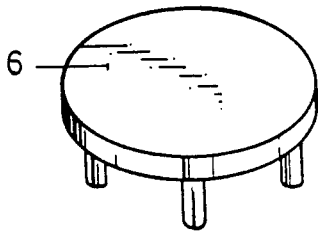
FIG. 2E is a out-side view of the supporting rack in the kiln chamber.

The shell 3 of the kiln consists of two separated metal plates (FIG. 2C) to form an insulating space therebetween which serves as an air-cooling mechanism. That is, it can decrease temperatures from 1280° C. (inside the kiln) to 50° C. approximately (on the exterior surface of the shell 3).

A receptacle 7 is fixed on the exterior wall of the kiln for connecting the cords of the electrical couple and the temperature regulator 8. The temperature regulator 8 can be any known device and is beyond the scope of claim, therefore no more statement be offered here.

The above description and particularly the drawings set forth is done for the purposes of illustration only. It will be understood that many variations and modifications of the embodiments herein described will be obvious to those skilled in the art, and may be carried out without departing from the scope of the present invention.

I claim:

1. A domestic electric kiln which can also be used as an ordinary electric radiator comprising:

a double walled housing having a heated inner chamber;

a cover with an opening in the center thereof;

safety lock means for normally preventing removal of the cover during operation of the kiln;

a water pipe set beneath the bottom of the kiln for generating steam and having three openings, the first one being the water inlet, the third one being a heat conducting block seated in one opening of the water pipe and being in communication with the heated inner chamber to thereby supply heat to the water pipe to generate steam, and the third one being the steam outlet;

a supporting rack which also facilitates the spread of steam throughout the inner chamber;

means for allowing air to circulate between the double walls which serves as an air cooling mechanism; and a temperature regulator, both steam and hot air being in continuous flow in the kiln chamber.

2. The domestic electric kiln according to claim 1 wherein the safety lock comprises a bolt engaged with a ball bearing of an arm connected to the cover.

* * * * *